US007859816B2

(12) United States Patent
Huang

(10) Patent No.: US 7,859,816 B2
(45) Date of Patent: Dec. 28, 2010

(54) BISTABLE CONTACTOR DRIVE CIRCUIT

(75) Inventor: Jie Huang, Shenzhen (CN)

(73) Assignee: Emerson Network Power Energy System AB, Stockholm (SE)

( * ) Notice: Subject to any disclaimer, the term of this patent is extended or adjusted under 35 U.S.C. 154(b) by 553 days.

(21) Appl. No.: 11/794,846

(22) PCT Filed: Jan. 6, 2006

(86) PCT No.: PCT/CN2006/000010

§ 371 (c)(1),
(2), (4) Date: Jan. 28, 2008

(87) PCT Pub. No.: WO2006/072217

PCT Pub. Date: Jul. 13, 2006

(65) Prior Publication Data

US 2008/0204964 A1 Aug. 28, 2008

(30) Foreign Application Priority Data

Jan. 8, 2005 (CN) ..... 2005 1 0006043
Mar. 11, 2005 (CN) ..... 2005 1 0054654

(51) Int. Cl.
*H01H 47/22* (2006.01)

(52) U.S. Cl. ..... 361/194; 361/187

(58) Field of Classification Search ..... 361/187, 361/194; 335/177

See application file for complete search history.

(56) References Cited

U.S. PATENT DOCUMENTS

| | | | | |
|---|---|---|---|---|
| 5,914,850 | A | 6/1999 | Johansson et al. | |
| 6,538,541 | B1 * | 3/2003 | Kralik | 335/177 |
| 6,831,531 | B1 | 12/2004 | Giousouf et al. | |
| 2007/0146956 | A1 * | 6/2007 | Panzer et al. | 361/160 |

FOREIGN PATENT DOCUMENTS

| | | | |
|---|---|---|---|
| CN | 2469544 | Y | 1/2002 |

* cited by examiner

*Primary Examiner*—Danny Nguyen
(74) *Attorney, Agent, or Firm*—Harness, Dickey & Pierce, P.L.C.

(57) ABSTRACT

A bistable contactor drive circuit includes a series branch comprising a first relay coil and a control signal source is connected to a power supply. A third normally closed contact and an eighth normally opened contact of the first relay are connected to a positive electrode of the power supply. A first normally opened contact and a sixth normally closed contact are connected to a negative electrode of the power supply, a second movable contact is connected to a positive electrode of the bistable contactor coil, and a seventh movable contact thereof is connected to a seventh movable contact of a second relay. A negative electrode of the bistable contactor coil is connected to a second movable contact of the second relay. Other connections in the circuit provide for operation of the bistable contactor drive circuit.

12 Claims, 4 Drawing Sheets

BISTABLE CONTACTOR DRIVE CIRCUIT

FIELD OF THE INVENTION

The present invention relates to bistable contactors in the power electronic technology, and more specifically, to a bistable contactor drive circuit.

BACKGROUND OF THE PRIOR AR

Conventionally, either for a normally opened contactor to remain closed state or for a normally closed contactor to remain opened state, it requires remaining energy provided externally. A bistable contactor differs from an ordinary contactor in that, a bistable contactor can operate stably in both a normally opened state and a normally closed state, moreover, it doesn't requires externally provided remaining energy to remain either of these two working states. Therefore, from the environmental protection and energy saving point of view of today, using a control method of a bistable contactor will be a future trend.

The use of a bistable contactor can save energy, but the control of a bistable contactor is more complicated than that of an ordinary contactor. The drive coil of a bistable contactor has a positive electrode and a negative electrode. By default, when applying a positive pulse of a certain width to a bistable contactor from the positive electrode to the negative electrode, the state of the bistable contactor will be changed from the opened state to the closed state (the state will not change if formerly it is already the closed state); when applying a negative pulse of a certain width to a bistable contactor from the positive electrode to the negative electrode, the state of the bistable contactor will be changed from the closed state to the opened state (the state will not change if formerly it is already the opened state). The pulse widths and pulse amplitudes required by different bistable contactors can be acquired in technical manuals from different contactor manufacturers.

As shown in FIG. 1, in current industrial applications, all of the bistable contactor drive circuits output the control signal of CON-ON or CON-OFF through a microcomputer I/O interface. Through optically coupled isolation, the control signal drives a bridge circuit, which is composed of four metal oxide semiconductor field effect transistors (MOSFETs), to obtain the positive/negative pulses to the bistable contactor coil ends. The drawbacks of this control method are: i) It needs to introduce a microcomputer, and the control circuit is complicate and of high cost. ii) The bridge circuit of MOSFETs can be easily damaged by electrostatic charges during the operation process, which leads to control failures. All these result in that bistable contactors have not yet been widely promoted and adopted.

SUMMARY OF THE INVENTION

The present invention provides a bistable contactor drive circuit. It does not require introduction of a microcomputer, has advantages of simple circuit and low cost, and is not easily damaged by electrostatic charges during the operation process. Therefore, it overcomes the defects of the prior art.

The technical solution adopted by the present invention to solve its technical problems is: A bistable contactor drive circuit, comprising a first relay, a second relay, a bistable contactor, a seventh diode, an eighth diode and a delay circuit; a series branch comprising said first relay coil and a control signal source is connected to a power supply; a third normally closed contact and an eighth normally opened contact of said first relay are connected to a positive electrode of the power supply, a first normally opened contact and a sixth normally closed contact are connected to a negative electrode of said power supply, a second movable contact is connected to a positive electrode of said bistable contactor coil, and a seventh movable contact thereof is connected to a seventh movable contact of said second relay; a negative electrode of said bistable contactor coil is connected to a second movable contact of said second relay; a third normally closed contact of said second relay is connected to a cathode of the seventh diode, a sixth normally closed contact thereof is connected to an anode of the seventh diode, a first normally opened contact thereof is connected to an anode of the eighth diode, an eighth normally opened contact thereof is connected to a cathode of the eighth diode; a sampling end of said delay circuit is connected to the seventh movable contact of the first relay, and an output end thereof is connected to one end of said second relay coil; the other end of said second relay coil is connected to the negative electrode of the power supply.

Said delay circuit comprises a second diode, a third diode, a first resistor, a second resistor, a first capacitor and a triode; an anode of said second diode is connected to said sampling end, and a cathode thereof is connected to one end of said first resistor; a positive electrode of said first capacitor is connected to the other end of the first resistor, and a negative electrode thereof is connected to the negative electrode of the power supply; a base of said triode is connected to the positive electrode of said first capacitor, a collector thereof is connected to the positive electrode of the power supply, and an emitter thereof is connected to said output end; a cathode of said third diode is connected to the sampling end, an anode thereof is connected to the second resistor, and the other end of the second resistor is connected to the positive electrode of the first capacitor.

The second movable contact and the seventh movable contact of said first relay are linkage movable contacts; the second movable contact and the seventh movable contact of said second relay are linkage movable contacts.

The circuit further comprises an absorption circuit connected in parallel to said bistable contactor coil, said absorption circuit is a series branch composed of a fifth voltage regulation diode and a sixth voltage regulation diode, and a cathode of said fifth voltage regulation diode is connected to a cathode of said sixth voltage regulation diode.

Said absorption circuit further comprises a series branch composed of a third resistor and a second capacitor, said series branch is connected in parallel to said bistable contactor coil.

The circuit further comprises a first diode connected in reverse parallel to said first relay coil and a fourth diode connected in reverse parallel to said second relay coil.

The present invention further provides another bistable contactor drive circuit, comprising a first relay, a second relay, a bistable contactor, a seventh diode, an eighth diode and a delay circuit; a series branch comprising said first relay coil and a control signal source is connected to a power supply; a third normally closed contact and an eighth normally opened contact of said first relay are connected to a negative electrode of the power supply, a first normally opened contact and a sixth normally closed contact are connected to a positive electrode of said power supply, a second movable contact is connected to a positive electrode of said bistable contactor coil, and a seventh movable contact thereof is connected to a seventh movable contact of said second relay; a negative electrode of said bistable contactor coil is connected to a second movable contact of said second relay; a third normally closed contact of said second relay is connected to an anode of the seventh diode, a sixth normally closed contact thereof is connected to a cathode of the seventh diode, a first normally opened contact thereof is connected to a cathode of the eighth diode, an eighth normally opened contact thereof is connected to an anode of the eighth diode; a sampling end of said delay circuit is connected to the second movable contact of the first relay, and an output end thereof is connected to one end of said second relay coil; the other end of said second relay coil is connected to the negative electrode of the power supply.

Said delay circuit comprises a second diode, a third diode, a first resistor, a second resistor, a first capacitor and a triode; an anode of said second diode is connected to said sampling end, and a cathode thereof is connected to one end of said first resistor; a positive electrode of said first capacitor is connected to the other end of the first resistor, and a negative electrode thereof is connected to the negative electrode of the power supply; a base of said triode is connected to the positive electrode of said first capacitor, a collector thereof is connected to the positive electrode of the power supply, and an emitter thereof is connected to said output end; a cathode of said third diode is connected to the sampling end, an anode thereof is connected to the second resistor, and the other end of the second resistor is connected to the positive electrode of the first capacitor.

The second movable contact and the seventh movable contact of said first relay are linkage movable contacts; the second movable contact and the seventh movable contact of said second relay are linkage movable contacts.

The circuit further comprises an absorption circuit connected in parallel to said bistable contactor coil, said absorption circuit is a series branch composed of a fifth voltage regulation diode and a sixth voltage regulation diode, and a cathode of said fifth voltage regulation diode is connected to a cathode of said sixth voltage regulation diode.

Said absorption circuit further comprises a series branch composed of a third resistor and a second capacitor, said series branch is connected in parallel to said bistable contactor coil.

The circuit further comprises a first diode connected in reverse parallel to said first relay coil and a fourth diode connected in reverse parallel to said second relay coil.

The advantages of the present invention are: stable and reliable circuit, no necessity to introduce single chip microcomputers and vulnerable MOSFETs, simple circuit, and low cost. What is the most important, before and after the control process of this bistable contactor drive circuit, there is no energy loss in the control circuit.

DETAILED DESCRIPTION OF THE PREFERRED EMBODIMENTS

Hereinafter, the present invention will be further described with reference to the accompanying drawings and the preferred embodiments.

Figure 1:
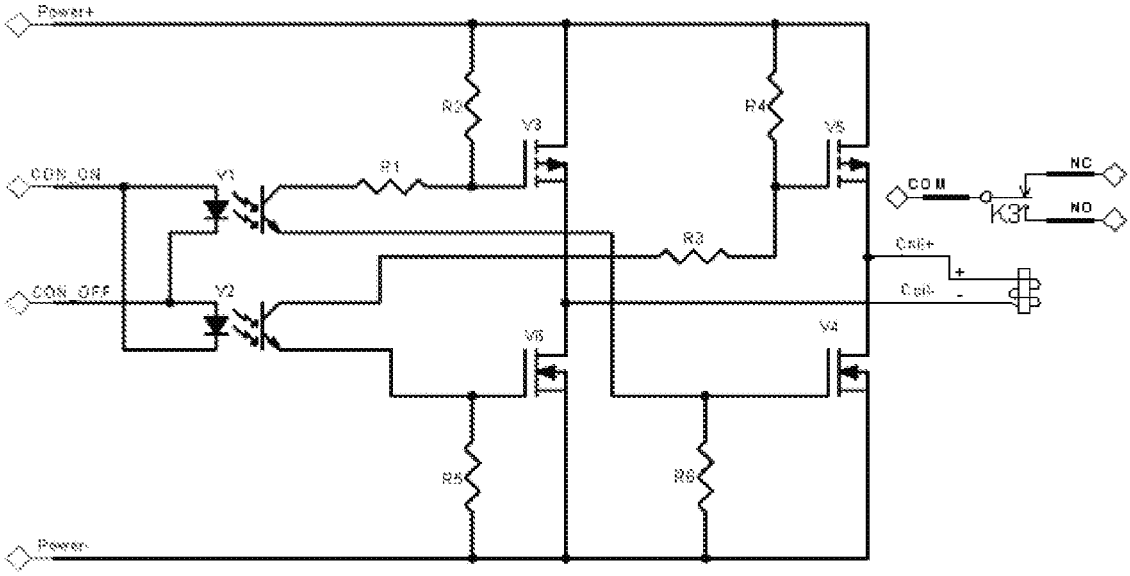
FIG 1 PRIOR ART
FIG. 1 is a schematic diagram of a bistable contactor drive circuit of the prior art.
Figure 2:
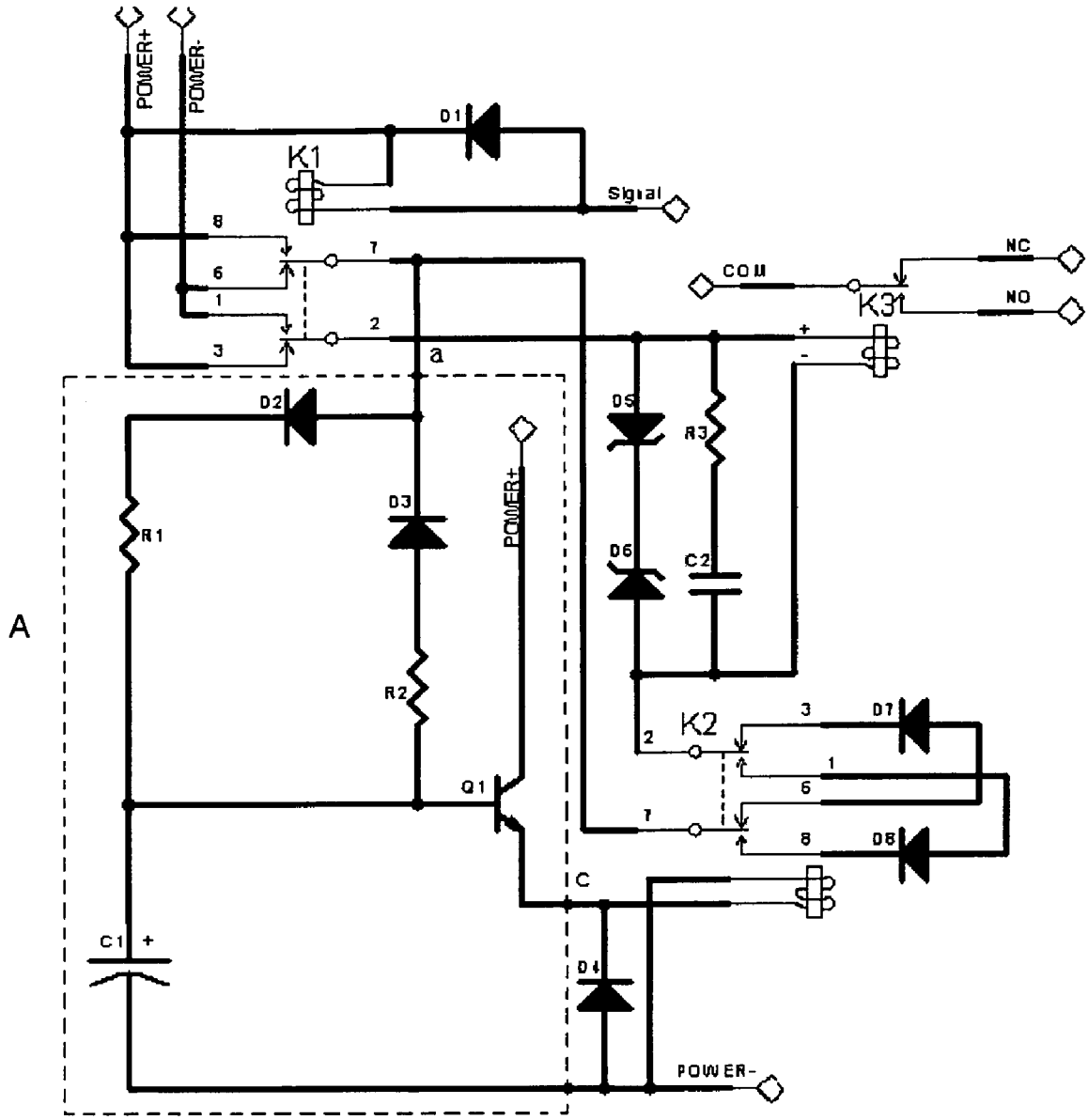
FIG. 2 is a schematic diagram of a circuit of the present invention.

Shown in FIG. 2 is a bistable contactor drive circuit suitable for a situation where the bistable contactor K3 is required for a long-term operation in the closed state. One end of a first relay K1 coil is connected to a positive electrode of a power supply, and the other end is connected to a control signal source SIGNAL, a third normally closed contact K1-3 and an eighth normally opened contact K1-8 of the first relay K1 are connected to the positive electrode of the power supply, a first normally opened contact K1-1 and a sixth normally closed contact K1-6 thereof are connected to a negative electrode of the power supply; a second movable contact K1-2 is connected to a positive electrode of a bistable contactor K3 coil, and a seventh movable contact K1-7 thereof is connected to a seventh movable contact K2-7 of a second relay K2; a negative electrode of the bistable contactor K3 coil is connected to a second movable contact K2-2 of the second relay K2; a third normally closed contact K2-3 of the second relay K2 is connected to a cathode of a seventh diode D7, a sixth normally closed contact K2-6 thereof is connected to an anode of the seventh diode D7, a first normally opened contact K2-1 thereof is connected to an anode of an eighth diode D8, and an eighth normally opened contact K2-8 thereof is connected to a cathode of the eighth diode D8; a sampling end a of a delay circuit A is connected to the seventh movable contact K1-7 of the first relay K1, and an output end c thereof is connected to one end of the second relay K2 coil; the other end of the second relay K2 coil is connected to the negative electrode of the power supply.

The delay circuit A comprises a second diode D2, a third diode D3, a first resistor R1, a second resistor R2, a first capacitor C1 and a triode Q1; an anode of said second diode D2 is connected to said sampling end a, and a cathode thereof is connected to one end of said first resistor R1; a positive electrode of said first capacitor C1 is connected to the other end of the first resistor R1, and a negative electrode thereof is connected to the negative electrode of the power supply; a base of said triode D3 is connected to the positive electrode of said first capacitor C1, a collector thereof is connected to the positive electrode of the power supply, and an emitter thereof is connected to said output end c; a cathode of said third diode D3 is connected to the sampling end a, an anode thereof is connected to the second resistor R2, and the other end of the second resistor R2 is connected to the positive electrode of the first capacitor C1.

In the circuit of FIG. 2, the second movable contact K1-2 and the seventh movable contact K1-7 of the first relay K1 are linkage movable contacts; the second movable contact K2-2 and the seventh movable contact K2-7 of the second relay K2 are linkage movable contacts. Further comprised is an absorption circuit connected in parallel to the bistable contactor K3 coil, said absorption circuit is a parallel circuit composed of two series branches. The two series branches are respectively: a series branch composed of a third resistor R3 and a second capacitor C2, and a series branch composed of a fifth voltage regulation diode D5 and a sixth voltage regulation diode D6, wherein a cathode of the fifth voltage regulation diode D5 is connected to a cathode of the sixth voltage regulation diode D6. A first diode D1 is connected in reverse parallel to the two ends of said first relay K1 coil. A fourth diode D4 is connected in reverse parallel to the two ends of said second relay K2 coil.

In the above circuit, the state of the first relay K1 is controlled by a signal from the control signal port SIGNAL. When the control signal port SIGNAL is floating, the circuit is operating in a standby state. The first relay K1 and the second relay K2 are not in operation. There is no current flowing through the bistable contactor K3 coil, and its contacts remain the closed state. Currently, there is no power consumption in the whole drive circuit.

When it is required to open the bistable contactor K3, simply connect the control signal port SIGNAL to the negative electrode of the power supply, the first relay K1 is thus actuated. A current flow from the positive electrode of the power supply flows through the eighth normally opened contact K1-8 and the seventh movable contact K1-7 of the first relay K1, the seventh movable contact K2-7 and the sixth normally closed contact K2-6 of the second relay K2, the seventh diode D7, the third normally closed contact K2-3 and the second movable contact K2-2 of the second relay K2, to the negative electrode of the bistable contactor K3 coil, then flows out of the positive electrode of the bistable contactor K3 coil, passes through the second movable contact K1-2 and the first normally opened contact K1-1 of the first relay K1, and returns to the negative electrode of the power supply. In this way, there is a current flowing from the negative electrode to the positive electrode through the bistable contactor K3 coil, the state of the bistable contactor K3 is then changed from the closed state to the opened state.

Simultaneously with the closure of the intermediate relay K1, the positive electrode of the power supply charges the first capacitor C1, through the eighth normally opened contact K1-8 and the seventh movable contact K1-7 of the first relay K1, the second diode D2, and the first resistor R1. As the voltage of the first capacitor C1 increases, the triode Q1 turns on, there is a current flowing through the second relay K2 coil, the second relay K2 is thus actuated, cutting off the current flowing through the bistable contactor K3 coil. To the bistable contactor K3 coil, it obtains a negative pulse. The pulse width is determined by the time constant of the first resistor R1 and the first capacitor C1. At this moment, there is almost no power consumption in the whole drive circuit.

When it is required to close the bistable contactor K3, the connection from the control signal port SIGNAL to the negative electrode of the power supply is disconnected, the first relay K1 is thus released. A current flow from the positive electrode of the power supply flows through the third normally closed contact K1-3 and the second movable contact K1-2 of the first relay K1, to the positive electrode of the bistable contactor K3 coil, then flows out of the negative electrode of its coil, passes through the second movable contact K2-2 and the first normally opened contact K2-1 of the second relay K2, the eighth diode D8, the eighth normally opened contact K2-8 and the seventh movable contact K2-7 of the second relay K2, the seventh movable contact K1-7 and the sixth normally closed contact K1-6 of the first relay K1, and returns to the negative electrode of the power supply. In this way, there is a current flowing from the positive electrode to the negative electrode through the bistable contactor K3 coil, the state of the bistable contactor K3 is then changed from the opened state to the closed state.

Simultaneously with the release of the intermediate relay K1, the first capacitor C1 discharges to the negative electrode of the power supply, through the second resistor R2, the third diode D3, the seventh movable contact K1-7 and the sixth normally closed contact K1-6 of the first relay K1, and another branch: the base Q1-*b* of the triode Q1, the emitter Q1-*e* of the triode Q1, and the second relay K2 coil. As the voltage of the first capacitor C1 decreases, the triode Q1 turns off, the second relay K2 is thus released, cutting off the current flowing through the bistable contactor K3 coil. To the bistable contactor K3 coil, it obtains a positive pulse. The pulse width is determined by the RC time constant composed of the first resistor R1, the first capacitor C1 and the impedance of the second relay K2 coil. At this moment, there is no power consumption in the whole drive circuit.

In the above circuit, the fifth diode D5, the sixth diode D6, the third resistor R3, and the second capacitor C2 constitute an absorption circuit for the time of the abrupt change of current in the bistable contactor K3 coil. When the second relay K2 cuts off the driving current in the bistable contactor K3 coil, it clamps the voltage spike at the time of the abrupt change of current in the bistable contactor K3 coil. It reduces arcing when the contacts of the second relay K2 cut off the current in the circuit, therefore protecting the contacts of the second relay K2. The first diode D1 connected in reverse parallel to said first relay K1 coil and the fourth diode D4 connected in reverse parallel to said second relay K2 coil are freewheeling diodes, and are used to protect the control circuit from overvoltage damage.

In summary, the circuit shown in FIG. 2 is a bistable contactor drive circuit with standby in the closed state. It is suitable for a situation that the bistable contactor K3 is required for a long-term operation in the closed state, where the whole contactor drive circuit operates in a mode of almost no power consumption. When it is required to open the bistable contactor K3 for a short period of time, the whole drive circuit only needs to provide energy to maintain the actuation of the first relay K1 and the second relay K2, therefore there is almost no power consumption.

Figure 3:
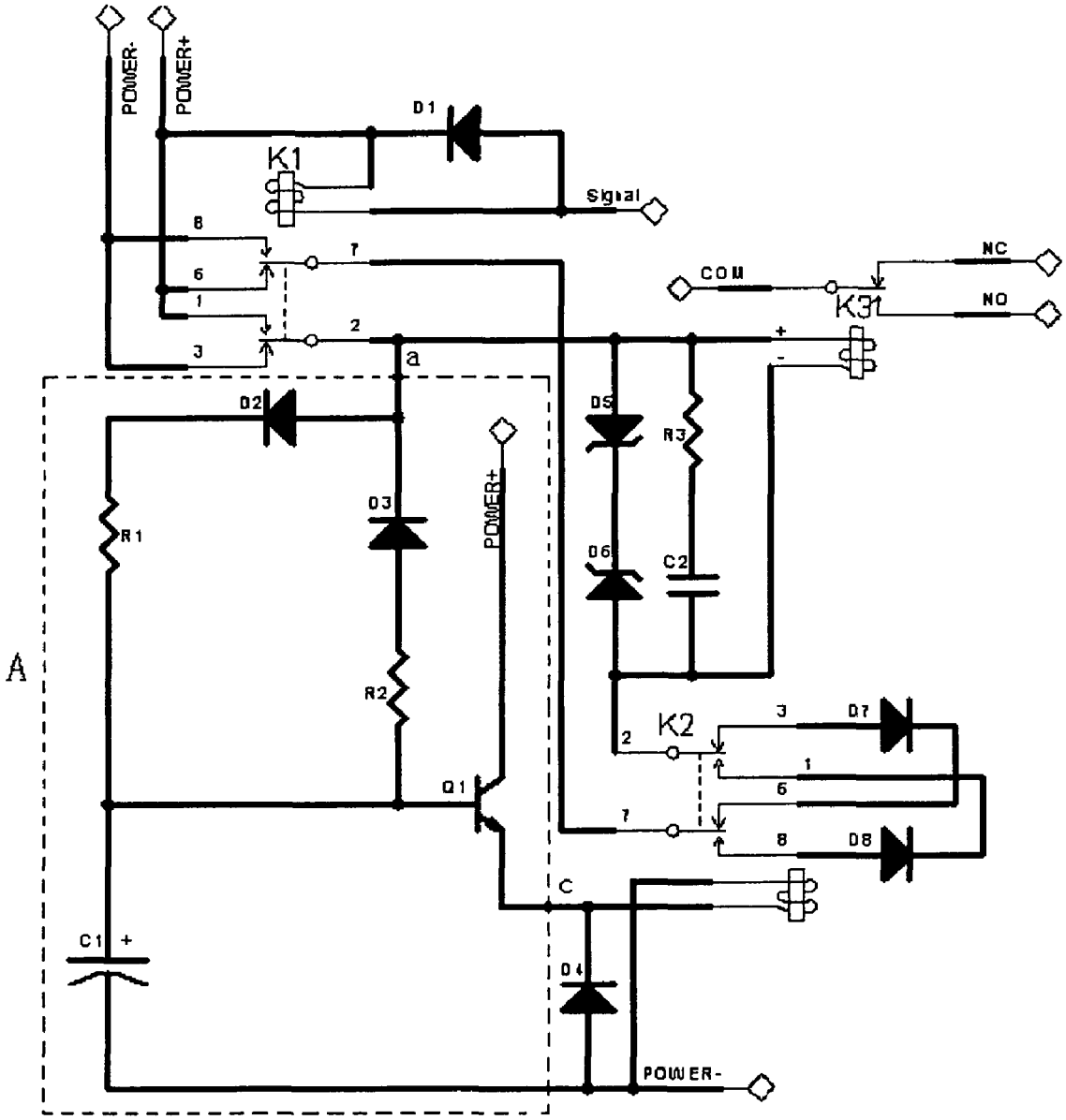
FIG. 3 is a schematic diagram of another circuit of the present invention.

Shown in FIG. 3 is a bistable contactor drive circuit suitable for a situation where the bistable contactor K3 is required for a long-term operation in the opened state. In comparison to the circuit shown in FIG. 2, there are only three differences in its connection method: i) The third normally closed contact K1-3 and the eighth normally opened contact K1-8 of the first relay K1 are connected to the negative electrode of the power supply, the first normally opened contact K1-1 and the sixth normally closed contact K1-6 thereof are connected to the positive electrode of the power supply. ii) The third normally closed contact K2-3 of the second relay K2 is connected to the anode of the seventh diode D7, the sixth normally closed contact K2-6 thereof is connected to the cathode of the seventh diode D7, the first normally opened contact K2-1 thereof is connected to the cathode of the eighth diode D8, and the eighth normally opened contact K2-8 thereof is connected to the anode of the eighth diode D8. iii) The anode of the second diode D2 and the cathode of the third diode D3 are connected to the second movable contact K1-2 of said first relay K1.

The principle of operation of the above circuit is the same as that of the circuit shown in FIG. 2. The state of the first relay K1 is controlled by a signal from the control signal port SIGNAL. When the control signal port SIGNAL is floating, the circuit is operating in a standby state. The first relay K1 and the second relay K2 are not in operation. There is no current flowing through the bistable contactor K3 coil, and its contacts remain the opened state.

When it is required to close the bistable contactor K3, simply connect the control signal port SIGNAL to the negative electrode of the power supply, the first relay K1 is thus actuated. A current flow from the positive electrode of the power supply flows through the first normally opened contact K1-1 and the second movable contact K1-2 of the first relay K1, to the positive electrode of the bistable contactor K3 coil, then flows out of the negative electrode of its coil, passes through the second movable contact K2-2 of the second relay K2, the seventh diode D7, the sixth normally closed contact K2-6 and the seventh movable contact K2-7 of the second relay K2, the seventh movable contact K1-7 and the eighth normally opened contact K1-8 of the first relay K1, and reaches the negative electrode of the power supply. In this way, there is a current flowing from the positive electrode to the negative electrode through the bistable contactor K3 coil, the state of the bistable contactor K3 is then changed from the opened state to the closed state.

Simultaneously with the closure of the intermediate relay K1, the positive electrode of the power supply charges the first capacitor C1, through the first normally opened contact K1-1 and the second movable contact K1-2 of the first relay K1, the second diode D2, and the first resistor R1. As the voltage of the first capacitor C1 increases, the triode Q1 turns on, there is a current flowing through the second relay K2 coil, the second relay K2 is thus actuated, cutting off the current flowing through the bistable contactor K3 coil. To the bistable contactor K3 coil, it obtains a positive pulse. The pulse width is determined by the time constant of the first resistor R1 and the first capacitor C1. Currently, there is almost no power consumption in the whole drive circuit.

When it is required to open the bistable contactor K3, the connection from the control signal port SIGNAL to the negative electrode of the power supply is disconnected, the first relay K1 is thus released. A current flow from the positive electrode of the power supply flows through the sixth normally closed contact K1-6 and the seventh movable contact K1-7 of the first relay K1, the seventh movable contact K2-7 and the eighth normally opened contact K2-8 of the second relay K2, the eighth diode D8, the first normally opened contact K2-1 and the second movable contact K2-2 of the second relay K2, to the negative electrode of the bistable contactor K3 coil, then flows out of the positive electrode of its coil, passes through the second movable contact K1-2 and the third normally closed contact K1-3 of the first relay K1, and returns to the negative electrode of the power supply. In this way, there is a current flowing from the negative electrode to the positive electrode through the bistable contactor K3 coil, the state of the bistable contactor K3 is then changed from the closed state to the opened state.

Simultaneously with the release of the intermediate relay K1, the first capacitor C1 discharges to the negative electrode of the power supply, through the second resistor R2, the third diode D3, the second movable contact K1-2 and the third normally closed contact K1-3 of the first relay K1, and another branch: the base Q1-*b* of the triode Q1, the emitter Q1-*e* of the triode Q1, and the second relay K2 coil. As the voltage of the first capacitor C1 decreases, the triode Q1 turns off, the second relay K2 is thus released, cutting off the current flowing through the bistable contactor K3 coil. To the bistable contactor K3 coil, it obtains a negative pulse. The pulse width is determined by the RC time constant composed of the first resistor R1, the first capacitor C1 and the impedance of the second relay K2 coil. Currently, there is no power consumption in the whole drive circuit.

The fifth diode D5, the sixth diode D6, the third resistor R3, and the second capacitor C2 constitute an absorption circuit for the time of the abrupt change of current in the bistable contactor K3 coil. When the second relay K2 cuts off the driving current in the bistable contactor K3 coil, it clamps the voltage spike at the time of the abrupt change of current in the bistable contactor K3 coil. It reduces arcing when the contacts of the second relay K2 cut off the current in the circuit, therefore protecting the contacts of the second relay K2. The first diode D1 connected in reverse parallel to said first relay K1 coil and the fourth diode D4 connected in reverse parallel to said second relay K2 coil are freewheeling diodes, and are used to protect the control circuit from overvoltage damage.

In summary, the circuit shown in FIG. 3 is a bistable contactor drive circuit with standby in the opened state. It is suitable for a situation that the bistable contactor K3 is required for a long-term operation in the opened state, where the whole contactor drive circuit operates in a mode of almost no power consumption. When it is required to close the bistable contactor K3 for a short period of time, the whole drive circuit only needs to provide energy to maintain the actuation of the first relay K1 and the second relay K2, therefore there is almost no power consumption.

The time delay function of the above delay circuit A can also be realized through digital chips.

The essence of the above two bistable contactor drive circuits is: The first relay K1 performs a polarity inversion function, while the second relay K2 performs a time delay function. The two relays mutually cooperate to accomplish the functionality of a pulse generator for positive/negative pulses of adjustable pulse width, and are capable of providing suitable positive/negative pulses for the driving of the bistable contactor coil. This circuit is stable and reliable, with no necessity for single chip microcomputers and vulnerable MOSFETs, and is of low cost. What is the most important, before and after the control process of this bistable contactor drive circuit, there is no energy loss in the control circuit. For the circuit shown in FIG. 4, its only difference from the circuit in FIG. 2 is that, one end of the first relay K1 coil is connected to the negative electrode of the power supply, and the other end is connected to the control signal source SIGNAL; the anode of the first diode D1 is connected to the negative electrode of the power supply, and the cathode thereof is connected to the control signal source SIGNAL.

Figure 4:
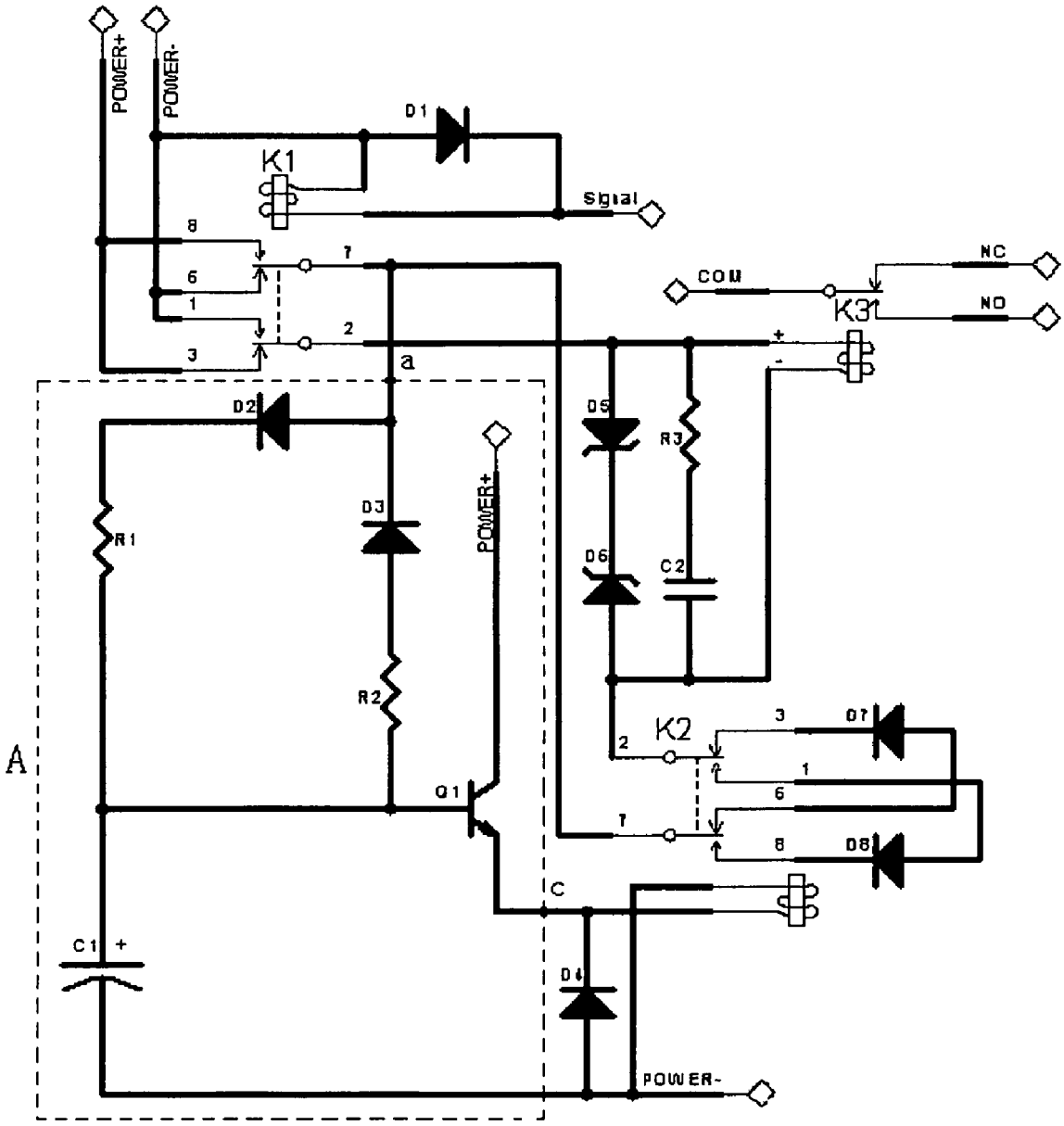
FIG. 4 is an embodiment of the present invention.

The principle of operation of the circuit shown in FIG. 4 is the same as that of the circuit in FIG. 2. It is also a bistable contactor drive circuit suitable for a situation where the bistable contactor K3 is required for a long-term operation in the closed state.

The invention claimed is:

1. A bistable contactor drive circuit, comprising a first relay (K1), a second relay (K2), a bistable contactor (K3), a seventh diode (D7), an eighth diode (D8) and a delay circuit (A); a series branch comprising said first relay (K1) coil and a control signal source (SIGNAL) connected to a DC power supply; a third normally closed contact (K1-3) and an eighth normally opened contact (K1-8) of said first relay (K1) connected to a positive electrode of the power supply, a first normally opened contact (K1-1) and a sixth normally closed contact (K1-6) connected to a negative electrode of the power supply, a second movable contact (K1-2) connected to a positive electrode of said bistable contactor (K3) coil, and a seventh movable contact (K1-7) thereof connected to a seventh movable contact (K2-7) of said second relay (K2); a negative electrode of said bistable contactor (K3) coil connected to a second movable contact (K2-2) of said second relay (K2); a third normally closed contact (K2-3) of said second relay (K2) connected to a cathode of the seventh diode (D7), a sixth normally closed contact (K2-6) thereof connected to an anode of the seventh diode (D7), a first normally opened contact (K2-1) thereof connected to an anode of the eighth diode (D8), an eighth normally opened contact (K2-8) thereof connected to a cathode of the eighth diode (D8); a sampling end (a) of said delay circuit (A) connected to the seventh movable contact (K1-7) of the first relay (K1), and an output end (c) thereof connected to one end of said second relay (K2) coil; the other end of said second relay (K2) coil connected to the negative electrode of the power supply.

2. The bistable contactor drive circuit according to claim 1, characterized in that said delay circuit (A) comprises a second diode (D2), a third diode (D3), a first resistor (R1), a second resistor (R2), a first capacitor (C1) and a triode (Q1); an anode of said second diode (D2) is connected to said sampling end (a), and a cathode thereof is connected to one end of said first resistor (R1); a positive electrode of said first capacitor (C1)

is connected to the other end of the first resistor (R1), and a negative electrode thereof is connected to the negative electrode of the power supply; a base of said triode (Q1) is connected to the positive electrode of said first capacitor (C1), a collector thereof is connected to the positive electrode of the power supply, and an emitter thereof is connected to said output end (c); a cathode of said third diode (D3) is connected to the sampling end (a), an anode thereof is connected to the second resistor (R2), and the other end of the second resistor (R2) is connected to the positive electrode of the first capacitor (C1).

3. The bistable contactor drive circuit according to claim 1, characterized in that the second movable contact (K1-2) and the seventh movable contact (K1-7) of said first relay (K1) are linkage movable contacts; the second movable contact (K2-2) and the seventh movable contact (K2-7) of said second relay (K2) are linkage movable contacts.

4. The bistable contactor drive circuit according to claim 1, further comprising an absorption circuit connected in parallel to said bistable contactor (K3) coil, said absorption circuit being a series branch composed of a fifth voltage regulation diode (D5) and a sixth voltage regulation diode (D6), and a cathode of said fifth voltage regulation diode (D5) connected to a cathode of said sixth voltage regulation diode (D6).

5. The bistable contactor drive circuit according to claim 4, characterized in that said absorption circuit further comprises a series branch composed of a third resistor (R3) and a second capacitor (C2), said series branch connected in parallel to said bistable contactor (K3) coil.

6. The bistable contactor drive circuit according to claim 1, further comprising a first diode (D1) connected in reverse parallel to said first relay (K1) coil and a fourth diode (D4) connected in reverse parallel to said second relay (K2) coil.

7. A bistable contactor drive circuit, comprising a first relay (K1), a second relay (K2), a bistable contactor (K3), a seventh diode (D7), an eighth diode (D8) and a delay circuit (A); a series branch comprising said first relay (K1) coil and a control signal source (SIGNAL) connected to a DC power supply; a third normally closed contact (K1-3) and an eighth normally opened contact (K1-8) of said first relay (K1) connected to a negative electrode of the power supply, a first normally opened contact (K1-1) and a sixth normally closed contact (K1-6) connected to a positive electrode of the power supply, a second movable contact (K1-2) connected to a positive electrode of said bistable contactor (K3) coil, and a seventh movable contact (K1-7) thereof connected to a seventh movable contact (K2-7) of said second relay (K2); a negative electrode of said bistable contactor (K3) coil connected to a second movable contact (K2-2) of said second relay (K2); a third normally closed contact (K2-3) of said second relay (K2) connected to an anode of the seventh diode (D7), a sixth normally closed contact (K2-6) thereof connected to a cathode of the seventh diode (D7), a first normally opened contact (K2-1) thereof connected to a cathode of the eighth diode (D8), an eighth normally opened contact (K2-8) thereof connected to an anode of the eighth diode (D8); a sampling end (a) of said delay circuit (A) connected to the second movable contact (K1-2) of the first relay (K1), and an output end (c) thereof connected to one end of said second relay (K2) coil; the other end of said second relay (K2) coil connected to the negative electrode of the power supply.

8. The bistable contactor drive circuit according to claim 7, characterized in that said delay circuit (A) comprises a second diode (D2), a third diode (D3), a first resistor (R1), a second resistor (R2), a first capacitor (C1) and a triode (Q1); an anode of said second diode (D2) is connected to said sampling end (a), and a cathode thereof is connected to one end of said first resistor (R1); a positive electrode of said first capacitor (C1) is connected to the other end of the first resistor (R1), and a negative electrode thereof is connected to the negative electrode of the power supply; a base of said triode (Q1) is connected to the positive electrode of said first capacitor (C1), a collector thereof is connected to the positive electrode of the power supply, and an emitter thereof is connected to said output end (c); a cathode of said third diode (D3) is connected to the sampling end (a), an anode thereof is connected to the second resistor (R2), and the other end of the second resistor (R2) is connected to the positive electrode of the first capacitor (C1).

9. The bistable contactor drive circuit according to claim 7, characterized in that the second movable contact (K1-2) and the seventh movable contact (K1-7) of said first relay (K1) are linkage movable contacts; the second movable contact (K2-2) and the seventh movable contact (K2-7) of said second relay (K2) are linkage movable contacts.

10. The bistable contactor drive circuit according to claim 7, further comprising an absorption circuit connected in parallel to said bistable contactor (K3) coil, said absorption circuit is a series branch composed of a fifth voltage regulation diode (D5) and a sixth voltage regulation diode (D6), and a cathode of said fifth voltage regulation diode (D5) is connected to a cathode of said sixth voltage regulation diode (D6).

11. The bistable contactor drive circuit according to claim 10, characterized in that said absorption circuit further comprises a series branch composed of a third resistor (R3) and a second capacitor (C2), said series branch is connected in parallel to said bistable contactor (K3) coil.

12. The bistable contactor drive circuit according to claim 7, further comprising a first diode (D1) connected in reverse parallel to said first relay (K1) coil and a fourth diode (D4) connected in reverse parallel to said second relay (K2) coil.

* * * * *